United States Patent [19]

Ross et al.

[11] 4,234,988

[45] Nov. 25, 1980

[54] PAIL OPENING DEVICE

[76] Inventors: Charles Y. Ross; Deltha M. Ross, both of P.O. Box 1390, Burney, Calif. 96013

[21] Appl. No.: 1,362

[22] Filed: Jan. 5, 1979

[51] Int. Cl.[3] ..... B25F 1/00

[52] U.S. Cl. ..... 7/151; 7/161; 30/450

[58] Field of Search ..... 7/151, 152, 156, 161; 30/165, 296 R, 450

[56] References Cited

U.S. PATENT DOCUMENTS

| | | | |
|---|---|---|---|
| 28,208 | 5/1860 | Snedeker | 7/151 X |
| 2,167,212 | 7/1939 | Johnson | 30/165 |
| 2,413,528 | 12/1946 | Speaker | 7/152 X |
| 3,142,903 | 8/1964 | Stiller | 30/450 |

*Primary Examiner*—James G. Smith

*Attorney, Agent, or Firm*—Herbert C. Schulze

[57] ABSTRACT

This invention is a tool for removing plastic lids from pails used in the supply of food stuffs, syrup, paints, and the like. This invention includes a handle with a floating knife blade of such configuration that it is adapted quickly to cut slots around the edge of such a plastic lid and contains, further, a prying means to bend the cut edges in order that the lids may be easily removed.

2 Claims, 10 Drawing Figures

PAIL OPENING DEVICE

CROSS REFERENCE TO RELATED PATENT APPLICATIONS

This invention is not related to any other patent application filed by us.

BACKGROUND OF THE INVENTION

1. Field of the Invention

This invention is in the general field of tools, and is more directly applied to tools utilized for the removal of lids from pails, and the like, and is more particularly directed to a tool for the removal of plastic lids which are crimped about the upper edge of a pail opening, and is most specifically directed to such a tool incorporating a knife and a bending mechanism for cutting, bending and removing plastic lids from pails.

2. Description of the Prior Art

There is no prior art known to us directly in the scope of this invention. It is known to us that it is customary to use knives of various types to cut the edges of crimped plastic lids into segments about the edge of such lids and then to use pliers, or the like, for purposes of prying the lid off. It is sometimes also known to use cutting tools such as scissors-type instruments for cutting the segments around the edge of the lid. However, there has not yet been known to any device incorporating the combined features of this invention as set forth in the specification and drawings of this application.

SUMMARY OF THE INVENTION

It is customary to provide numerous materials such as syrups, paints, various foodstuffs, and the like, in pails. Frequently such pails are of approximately 5-gallon size although there is nothing critical about the size as such. A great number of such pails, which have a completely open end on one end, utilize plastic lids which are so formed as to have an edge which crimps down about the outer edge of the pail itself to hold a tight seal.

Customarily the crimped edge of the plastic lid will be provided with a number of openings to facilitate insertion of a knife, or the like, in order to cut the crimped edge into a number of segments, which segments can then be lifted to enable removal of the lid from the pail. It is always a cumbersome operation to cut these edges and frequently it is dangerous since a knife can slip and cause damage due to the difficulty of getting the knife within the opening provided. Even after the slots are cut, it then becomes difficult to pry the segments of the lid in such a manner that the lid is easily removable from the pail.

We have worked with this problem for a long period of time and have now developed and extensively tested an excellent and unique tool for this purpose. Our tool comprises a handle suitable to accommodate the human hand and having near one end a pivotally mounted, hook-shaped knife blade. Cooperative with the knife blade is a basically U-shaped bracket which is used for leverage against the lid for the utilization of the knife blade to cut the crimped edges and, at the same time, becomes a gripping element for the edges, used for bending the edges and removing the cut lid from the pail.

By the use of this device, there is no danger of slippage of the knife blade with the resultant possibility of injury, and it is not necessary to have more than one tool to quickly remove these lids.

It is an object of this invention to provide a tool for utilization in the combined operations of cutting segments around a crimped pail lid and bending the segments for removal.

Another object of this invention is to provide such a tool as heretofore described which will be safe in use and will eliminate the danger of injury in the removal of lids.

The foregoing and other objects and advantages of this invention will become apparent to those skilled in the art upon reading the description of a preferred embodiment which follows in conjunction with a review of the appended drawings.

DESCRIPTION OF A PREFERRED EMBODIMENT

Figure 1:
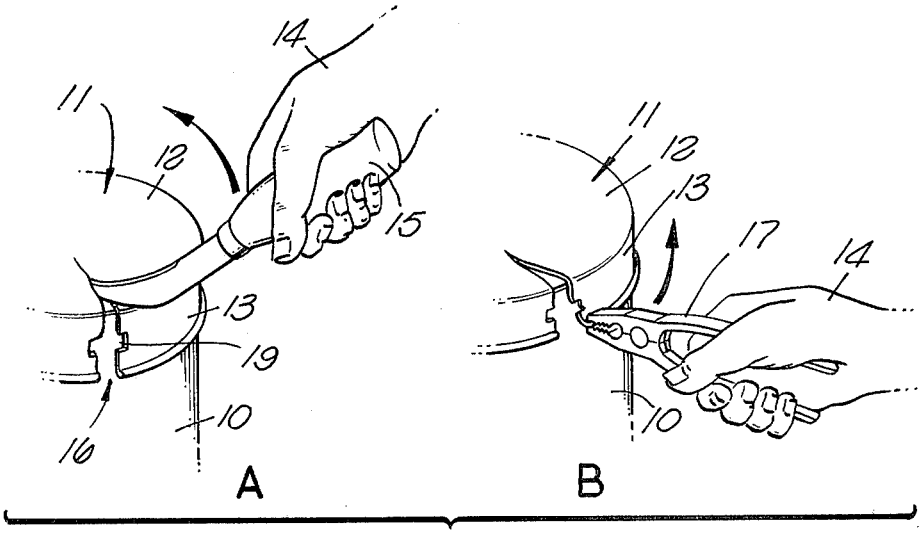
FIG. 1 PRIOR ART
FIG. 1 is an illustration of the prior art in this field, FIG. 1A being the cutting operation and FIG. 1B being the bending and lid removing operation.
Figure 2:
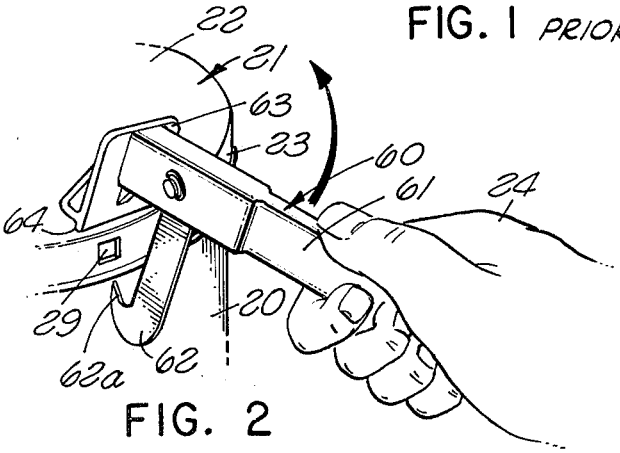
FIG. 2 is a perspective of a preferred embodiment of a device of this invention in position prior to cutting the edge of the pail lid.

Plastic lids on pails utilized as shipping and storage containers frequently are formed of plastic material shaped to adhere to the end of an otherwise open ended pail. Such plastic lids customarily have an opening, or a series of openings, such as that shown at 19 in FIG. 1A. The pail 10 of FIGS. 1A and 1B is a customary pail and the lid 11 is the lid as previously described, including the top portion 12 and the downwardly depending edge 13 which grips the top of the pail 10.

Customarily, a knife 15, or the like, will be utilized in the hand 14 of one using the pail. By the use of the knife in a customary manner the slot opening 16 will be made. Thereafter, the user will take a pliers 17, or the like, and pry or bend the edge 13 upward until it is possible to remove the lid 11.

FIGS. 2, 3, 4, and 5 show a preferred embodiment of the present invention in use and its method of use. The pail 20, has a lid, generally 21, comprising a top flat portion 22 with a downwardly depending rim 23. An opening or openings 29 will customarily be provided but, if not provided, this tool would still work in the same manner.

The device, generally 69, includes a handle 61 suitable to be gripped by a human hand 24. At its end opposite from the handle end, there is a member 63 terminating in an edge 64 suitable to be used as a leverage position. Also attached to the end 63 is a generally U-shaped device being formed from the end piece 63, a lower base 65 and a lip 66.

A knife blade 62 is pivotally connected to the handle 61 and is held in position for operation by a spring which will be described in detail in connection with FIGS. 6–10.

Figure 3:
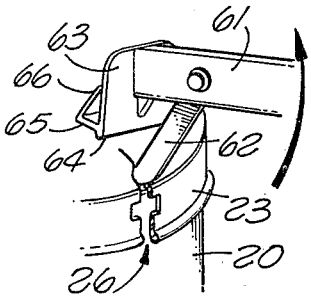
FIG. 3 is a perspective of the same area of the pail as is shown in FIG. 2 showing the knife blade on the tool having nearly completed its cutting operation.

In use, the leverage edge 64 is placed against the top 21 of the lid and the knife blade 62*a*, carried by knife body 62, is caused to slip under the edge 23 where it presses against the pail 20. As shown in FIG. 3, the knife then works its way upwardly leaving an opening 26 in the edge 23.

Customarily, a number of such slots will be made to facilitate removal, although it is possible to do so with one slot, depending upon the exact configuration of the pail and lid.

Figure 4:
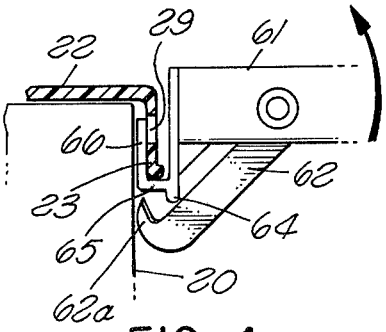
FIG. 4 is a side elevation of the pail and lid of FIGS. 1 and 2, but showing the preferred embodiment of this invention in position to bend the previously cut pail lid.
Figure 5:
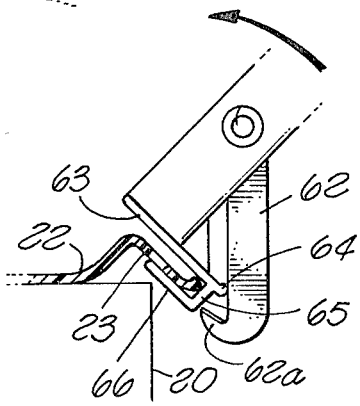
FIG. 5 is the same view as FIG. 4, but with the device of this invention rotated upward in the operation of removing the pail lid.

After the edge 23 has been cut, and as shown particularly in FIGS. 4 and 5, the front lip 66 is slipped under the edge 23 and then, by rotating the handle 61 upwardly, the edge 23 is bent upward to facilitate removal of the lid as will be clear in FIG. 5.

The construction of this device is well illustrated in FIGS. 6, 7, 8, 9, and 10. The handle portion 61 includes an appropriately formed portion having preferably recesses at 61*b* for the purpose of lightness and strength.

At the same time, the handle portion is expanded at 61*a* in order to provide the necessary thickness for the mounting of the knife and its positioning spring.

A slot is formed at 80 in the enlarged portion 61*a* of the handle. The slot 80 is suitable for mounting spring 74 on a pin 75 bridging the slot as shown. The spring 74 has a hook 75*a* to hold it upon pin 75 and another hook 74*a* which hooks into a hole 73 in knife blade carring member 62. The knife blade carrying member 62 is pivotally mounted by a pin 70, or the like, retained as indicated by snap fasteners 71 and 72, or the like. This could also be fastened with screws of various types, snap rings, or any other means known to those skilled in the art.

Figure 6:
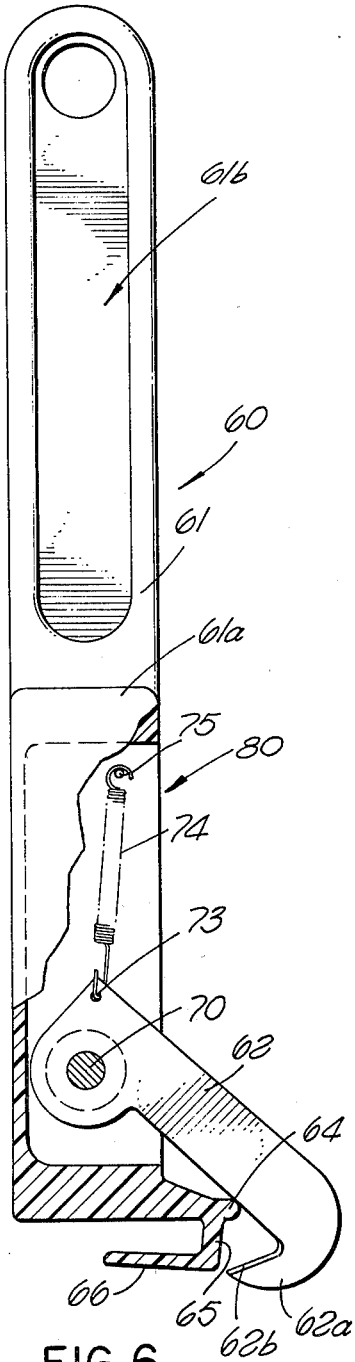
FIG. 6 is a partially broken-away and partially sectioned side elevation of the device used in FIGS. 2, 3, 4 and 5.
Figure 7:
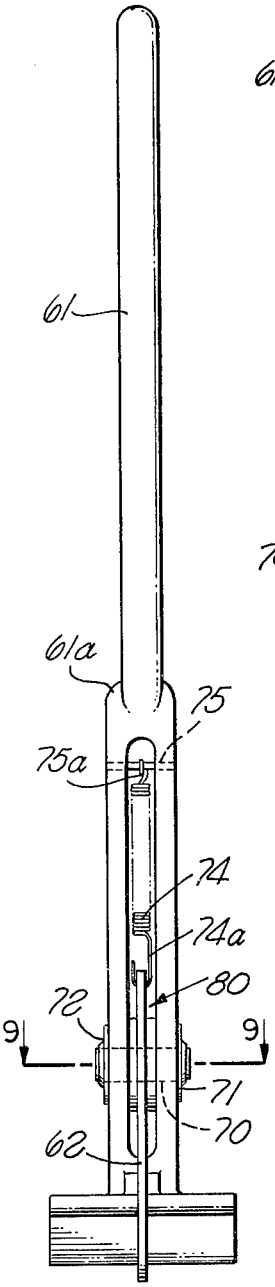
FIG. 7 is an edge elevation of the device of FIG. 6 from the right edge as appearing in FIG. 6.
Figure 8:
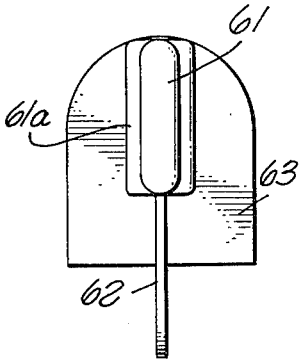
FIG. 8 is a top plan on FIG. 7.
Figure 9:
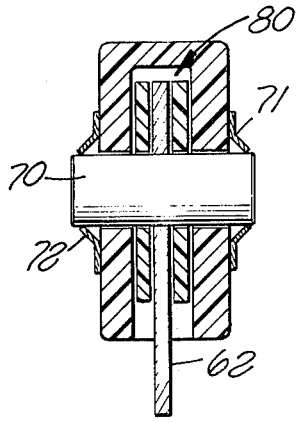
FIG. 9 is a section on 9—9 of FIG. 7.
Figure 10:
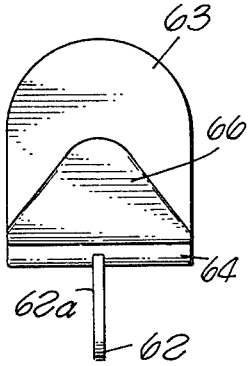
FIG. 10 is a bottom elevation on FIG. 7.

The knife blade thus is held in its forward position, as shown in FIG. 6, by the spring and by means of its pivotal mounting arrangement under normal circumstances. When it is ready to be used, the knife blade will be able to pivot as is clear in FIGS. 2 and 3 to accommodate the changing location during the cutting operation.

The pivot position 64, and its functioning, will be understood by those skilled in the art; and, the formation of the U-shaped member, comprising in combination the end piece 63 and the base 65 and front lip 66, complete the tool for the purposes as shown.

It is thus clear that, by the utilization of this tool, the knife blade is always urged in a position from which it cannot slip and cause injury; and, proper leverage may be applied in the manner as indicated. Subsequent to the cutting, the lid is easily bent as is illustrated and will be clear to those skilled in the art.

While the embodiment of this invention shown and described is fully capable of achieving the objects and advantages desired, it will be clear to those skilled in the art that this embodiment has been shown for purposes of illustration only, and not for purposes of limitation.

We claim:

1. An apparatus for cutting plastic lids upon pails and prying the same off of the pail comprising in combination: an elongated handle means suitable to be gripped by a human hand and having a pair of recessed portions on its sides; an enlarged end depending from said handle and including therein a slot suitable to accommodate a knife means; an axle mounted through said enlarged portion of said handle and extending transversely through said slot; knife means mounted at one end in a pivotal manner upon said axle; spring means mounted within said slot and connected to said knife means to hold the same in a fixed position in such manner that the knife blade is always urged forward and upward; knife blade means attached to said knife means mounted in said slot comprising a hook-like sharpened blade; pivot leverage means depending from said enlarged portion of said handle means suitable to rest against the top of a plastic lid in place upon a pail; lip means connected to said pivot leverage point in such manner as to provide a prying member depending forwardly from said handle means; and means adjacent the end of said handle means opposite from said pivot leverage point for hanging said device when not in use.

2. A tool for removing lids from pails comprising in combination handle means having a slot therein suitable to be gripped by a human hand; an enlarged portion upon said handle means; a leverage point adjacent the end of said enlarged portion of said handle means; a knife blade terminating in a hook-like member suitable to slip under the edge of a pail lid pivotally mounted upon said enlarged portion within said slot with its cutting edge depending outwardly therefrom adjacent said leverage point; means holding said knife blade in a predetermined cooperative relationship with said leverage point and cooperative therewith to provide a cooperative pivotal cutting device; and a prying apparatus connected to said enlarged portion of said handle means.

* * * * *